US006234187B1

(12) United States Patent
Izzo

(10) Patent No.: US 6,234,187 B1
(45) Date of Patent: May 22, 2001

(54) ADJUSTABLE BEACH CHAIR UMBRELLA

(76) Inventor: Linda F. Izzo, P.O. Box 1622, Sunset Beach, CA (US) 90742

( * ) Notice: Subject to any disclaimer, the term of this patent is extended or adjusted under 35 U.S.C. 154(b) by 0 days.

(21) Appl. No.: 09/344,625

(22) Filed: Jun. 25, 1999

Related U.S. Application Data

(60) Provisional application No. 60/090,818, filed on Jun. 26, 1998.

(51) Int. Cl.[7] ..... F16M 13/02; A45B 3/00

(52) U.S. Cl. ..... 135/98; 135/15.1; 135/16; 135/19; 248/297.12

(58) Field of Search ..... 135/95, 98, 16, 135/19, 15.1; 248/297.12

(56) References Cited

U.S. PATENT DOCUMENTS

| | | | | |
|---|---|---|---|---|
| 235,106 | * | 12/1880 | Steiner | 135/98 X |
| 336,363 | * | 2/1886 | Ward | 135/98 X |
| 3,879,086 | * | 4/1975 | Moceri | 135/16 X |
| 4,809,724 | * | 3/1989 | Fuser | 135/16 |
| 4,871,141 | | 10/1989 | Chen . | |
| 5,004,134 | | 4/1991 | Barry . | |
| 5,058,757 | | 10/1991 | Proa . | |
| 5,110,184 | | 5/1992 | Stein et al. . | |
| 5,188,331 | * | 2/1993 | Baines | 135/16 X |
| 5,269,157 | | 12/1993 | Ciminelli et al. . | |
| 5,297,570 | * | 3/1994 | Conner | 135/16 |

* cited by examiner

*Primary Examiner*—Christopher T. Kent
(74) *Attorney, Agent, or Firm*—Knobbe, Martens, Olson & Bear, LLP.

(57) ABSTRACT

An adjustable umbrella apparatus is disclosed comprising an umbrella with a canopy and a rod. A connector is attached to the rod and has a pair of prongs extending therefrom. The connector is disposed within a channel formed in an umbrella base. The connector prongs are spring-loaded relative to the connector body within the channel and, when released, the prongs are urged through corresponding lock holes to retain the umbrella in a desired position relative to the umbrella base. When the spring-loaded prongs are compressed, the connector may be slid within the channel longitudinally or rotatably relative to the longitudinal axis of the channel. In this manner, the umbrella may be adjusted longitudinally and rotatably to a chosen orientation and held securely in place in that chosen orientation. The umbrella base is formed integral with or attachable to a framed chair such as a beach chair.

20 Claims, 3 Drawing Sheets

ADJUSTABLE BEACH CHAIR UMBRELLA

RELATED APPLICATIONS

This application claims priority under 35 U.S.C. 119(e) from Provisional Application No. 60/090,818, filed on Jun. 26, 1998.

BACKGROUND OF THE INVENTION

1. Field of the Invention

This invention relates to the field of shade umbrellas and more particularly to an adjustable shade umbrella.

2. Description of the Related Art

Umbrellas are often used to provide welcome shady relief from the hot sun in areas such as beaches, swimming pools, parks and patios. Some sun umbrellas are designed to be used in conjunction with beach chairs or other outdoor chairs to provide shade for a person sitting in the chair. As the day passes, however, the location of the sun relative to the chair changes, thus necessitating an adjustment in the placement of the umbrella. If the umbrella is not adjustable, the person using the chair may have to repeatedly move the chair as the day passes to maintain adequate shade because of the changing angle of the sun's rays. Moving the chair is inconvenient and frustrating.

U.S. Pat. No. 4,871,141, to Chen, discloses an adjustable umbrella support which is adapted to be attached to a beach chair. The umbrella support attaches to a tubular side frame of the beach chair and the rod of the umbrella has flexible portions to allow adjustment of the umbrella without moving the chair.

This design, however, has a number of key limitations. For instance, since the support is located on the side frame member, the support is likely to get in the way of a user's arm or shoulder when the user is seated in the chair. Also, when the umbrella is adjusted to a desired shade-producing position, the bending umbrella shaft is likely to be positioned at least partially in front of the user's face and chest. Such placement is uncomfortable and inconvenient. Additionally, since the support is mounted to a side of the chair, the umbrella's range of adjustment is limited and some sun angles cannot be adequately shaded without removing the support and reinstalling it on the other side of the chair. Further, the flexible portions of the umbrella rod may become loose over time; thus, the umbrella may be unable to maintain a chosen position without sagging. Also, breezes may change the umbrella's position.

Some beach chair umbrella embodiments are attached to a beach chair arm rest by a C-clamp or other clamping means. This is undesirable because, first of all, the attachment uses the arm rest and is thus in the way of the person sitting in the chair. Also, such attachment methods have proven somewhat unstable, particularly in windy conditions. The gripping member is also subject to wear, requiring that the clamp be secured tighter and tighter to the chair over time. Further, this clamping means may damage the beach chair.

SUMMARY OF THE INVENTION

Accordingly, there is a need in the art for an adjustable beach chair umbrella that can be adjusted to accommodate a full range of motion while remaining out of the way of a person sitting in the chair. There is a further need for an umbrella that can be attached to a chair and is adjustable without requiring a user to move the chair. Also, there is a need for an adjustable umbrella that maintains its position once adjusted.

In accordance with one aspect of the present invention, an adjustable umbrella apparatus is disclosed having a shuttle adapted to slide along a track. The shuttle has a first interlock portion. A second interlock portion is adapted to engage the first interlock portion to releasably lock the shuttle in a first position. Similarly, a third interlock portion is adapted to engage the first interlock portion to releasably lock the shuttle in a second position. An umbrella rod is connected to the shuttle and is adapted to move with the shuttle.

In accordance with another aspect of the present invention, an adjustable umbrella system is provided comprising an umbrella having a canopy and a shaft supporting the canopy. A connector is attached to a first end of the shaft. The connector is adapted to engage a base and to move longitudinally along the base and rotatably about a longitudinal axis of the base. An interlock on the base engages the connector and releasably locks the connector in a position.

In accordance with yet another aspect of the present invention, an adjustable umbrella system is disclosed comprising an umbrella including a rod supporting a canopy at a first end of the rod. The system further includes a connector on a second end of the rod. The connector is adapted to releasably engage a base. A plurality of protrusions extend from the base or the connector. The protrusions are adapted to engage the other of the base or connector to retain the connector in a position relative to the base.

In accordance with a still further aspect of the present invention, an adjustable umbrella apparatus is disclosed comprising an umbrella with a canopy and a rod. The apparatus also includes a base and a channel formed in the base. The channel has a longitudinal portion and a transverse portion. A plurality of lock holes are located adjacent the channel. A connector is attached to the umbrella rod and is adapted to slide within the base. The connector includes an interlock which is adapted to engage at least one of the lock holes.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred emnbodiment(s) disclosed.

DETAILED DESCRIPTION OF THE PREFERRED EMBODIMENTS

Figure 1:
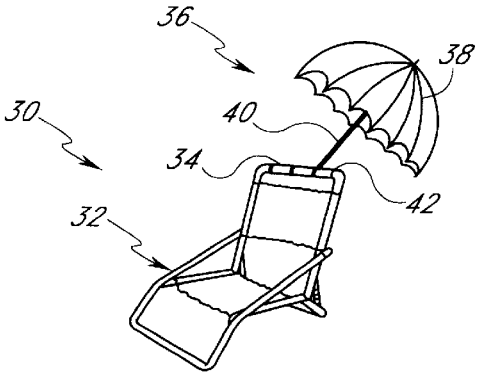
FIG. 1 is a perspective view of a beach chair including an adjustable umbrella having features in accordance with the present invention.
Figure 2:
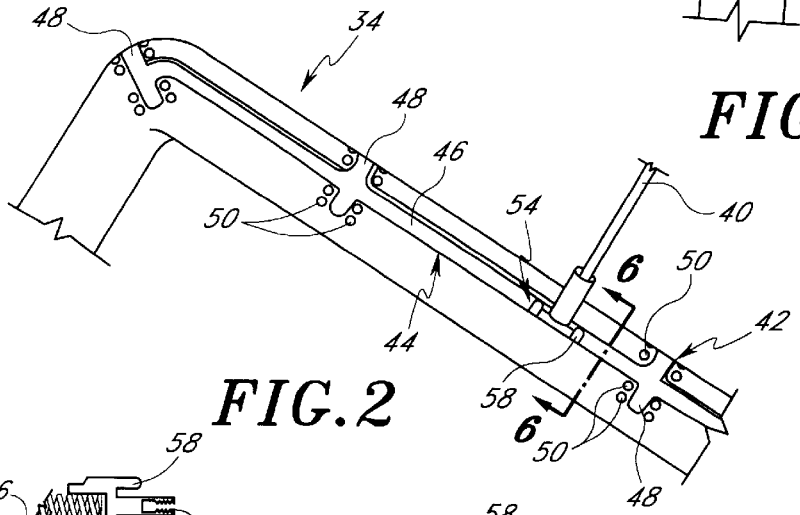
FIG. 2 is a cut-away view of a track portion of the beach chair of FIG. 1.

Referring first to FIG. 1, a beach chair 30 is disclosed having a hollow tubular frame 32 including a hollow top frame member 34. A sun umbrella 36 comprising a canopy 38 and a rod 40 is adjustably attached to the beach chair 30 at the top frame member 34. Referring next to FIG. 2, a track 42 is formed in the top frame member 34 of the beach chair 30. The track 42 preferably comprises a channel 44 with a longitudinal portion 46 and a plurality of transverse portions 48. Lock holes 50 are disposed at various points along the channel 44. Preferably, the lock holes 50 are arranged in pairs with each lock hole 50 on one side of the channel 44 corresponding to an opposing lock hole 50 on the other side of the channel 44. A shuttle or connector 54 slides within the track 42 and is adapted to releasably engage the lock holes 50. The connector 54 is attached to an end of the umbrella rod 40.

Figure 4:
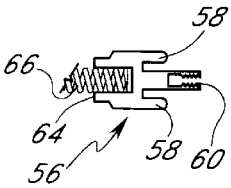
FIG. 4 is a cross-sectional side view of the interlock of FIG. 3.
Figure 3:
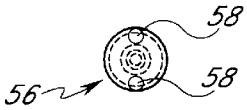
FIG. 3 is a top view of an interlock for use with an umbrella as in FIG. 1.
Figure 5:
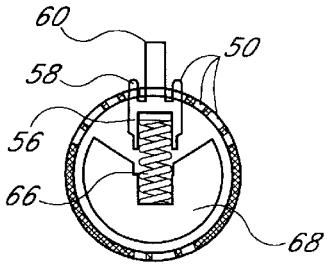
FIG. 5 is a cross-sectional view of a shuttle including the interlock of FIG. 4 disposed in the track of FIG. 2 in a "locked" position.

Referring also to FIGS. 3 and 4, the connector 54 includes an interlock body 56 which preferably has a pair of opposing prongs 58 extending therefrom. A threaded attachment portion 60 of the body is adapted to accept a threaded free end of the umbrella rod 40. The body 56 also has a spring cavity 64 which is adapted to accept a spring 66. Referring next to FIG. 5, the connector 54 includes a shuttle base 68 which is adapted to receive the spring 66. Thus, the spring 66 operates between the shuttle base 68 and the body 56 to bias the body 56 away from the base 68. FIG. 5 also shows the shuttle's 54 position within a cross-section of the tubular track 42. As shown, the body prongs 58 are extending through a pair of lock holes 50 adjacent the channel 44. The umbrella 36 is retained in this "locked" position by the force exerted by the spring 66.

Figure 6:
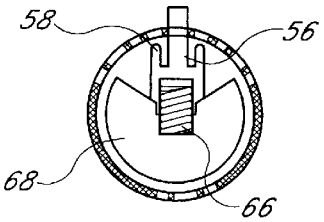
FIG. 6 depicts the shuttle of FIG. 5 in a compressed "unlocked" position.
Figure 7:
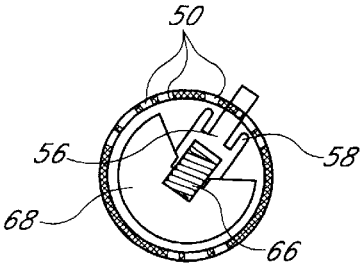
FIG. 7 depicts the shuttle of FIG. 5 in a compressed "unlocked" position and rotated within the track.

The umbrella 36 can be moved to the "unlocked" position shown in FIG. 6 by pushing on the umbrella rod 40 to compress the spring 66 and remove the prongs 58 from the lock holes 50. In this orientation, the shuttle 54 may be slid longitudinally within the track 42, moving the umbrella rod 40 along the longitudinal portion 46 of the channel 44. The shuttle 54 may also be rotated to move the rod 40 along a transverse portion 48 of a channel 44 as shown in FIG. 7. Thus, the umbrella 36 is longitudinally and rotatably adjustable relative to the chair 30.

Figure 8:
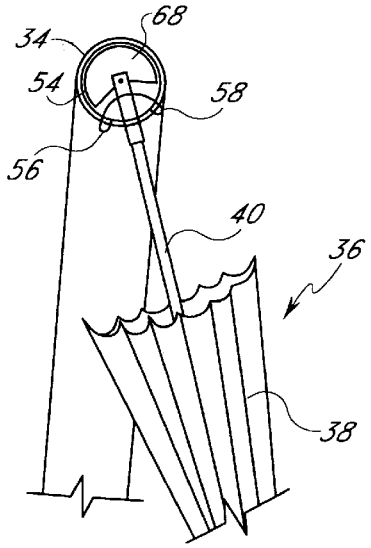
FIG. 8 shows an adjustable beach chair umbrella folded and rotated to a "transport" position.

With next reference to FIG. 8, at least one transverse portion 48 of the channel 44 preferably extends about 180° from the top longitudinal portion 46 of the channel 44. This arrangement enables the umbrella 36, when not in use, to be rotated to and locked in a position that is nearly parallel to the back of the beach chair 30. Thus, the umbrella 36 may be folded up for transportation with the beach chair 30.

Figure 10:
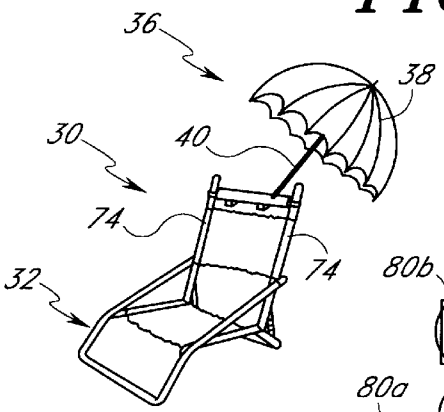
FIG. 10 depicts a perspective view of a beach chair in combination with another embodiment of a portable umbrella apparatus having features in accordance with the present invention.
Figure 9:
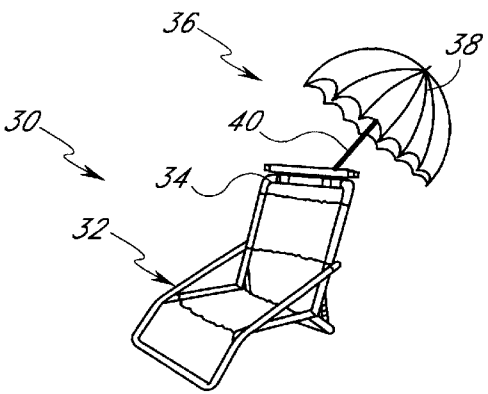
FIG. 9 is a perspective view of a beach chair in combination with a portable adjustable umbrella apparatus having features in accordance with the present invention.

With next reference to FIGS. 9 and 10, an adjustable umbrella 36 with a portable base 70 is disclosed. In these embodiments, a track 72 is formed within a base 70 which is independent of, but attachable to, a beach chair 30. The base 70 can be connected to the top frame member 34 of a beach chair, as shown in FIG. 9, but can also extend between two tubular side frame members 74, as shown in FIG. 10.

Figure 11:
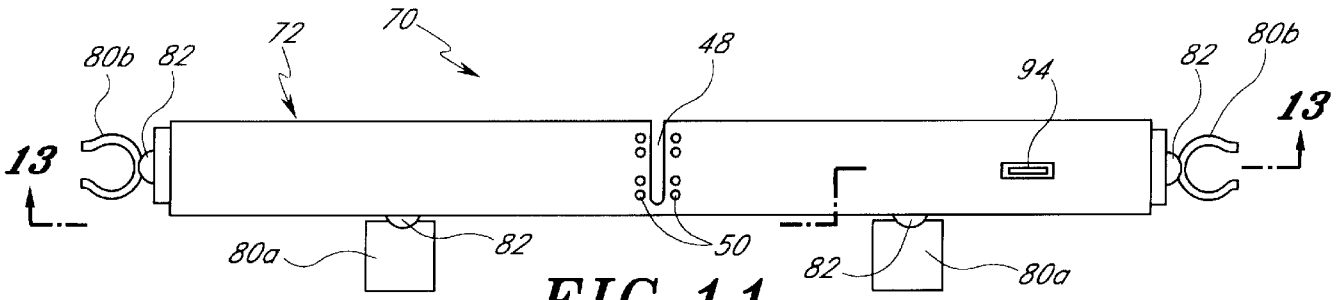
FIG. 11 is a back view of an umbrella base for use with the beach chairs of FIG. 9 and FIG. 10.
Figure 12:
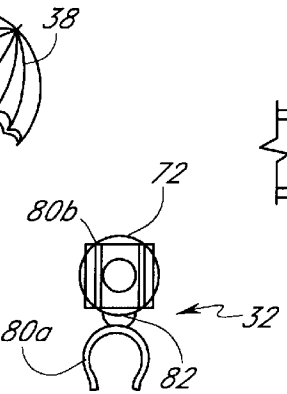
FIG. 12 is an end view of the umbrella base of FIG. 11.

Referring next to FIG. 11, a back view of the portable umbrella base 70 depicted in FIGS. 9 and 10 is provided. The umbrella base 70 preferably includes a track 72 adapted to slidably receive a shuttle 54 therein, preferably in a manner similar to that described above. Preferably, a plurality of anchors 80, such as clips, tabs, or screws, are disposed on the portable base 70. As shown in FIG. 11, two such anchors **80*a* preferably depend from the bottom of the portable base 70. Anchors 80*b* also preferably extend from each end of the portable base 70. The anchors 80*a*, 80*b* are preferably disposed on swivels 82, allowing the anchors to be positioned optimally for any installation arrangement. Referring also to FIG. 12, the anchors 80 are preferably resilient and substantially C-shaped in order to establish a snapping fit about a tubular chair frame, for instance, a beach chair frame 32**.

Figure 13:
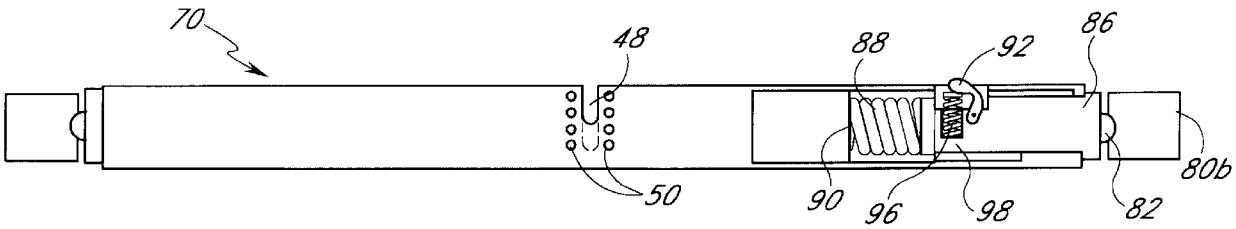
FIG. 13 is a partially cut-away bottom view of the umbrella base of FIG. 11.
Figure 14:
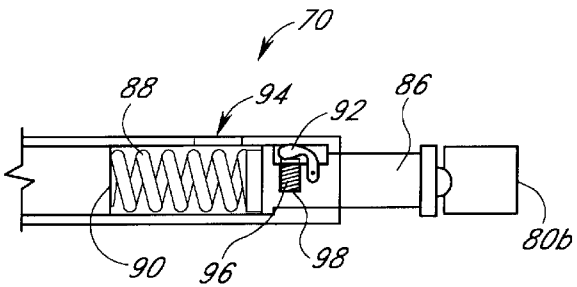
FIG. 14 is a cut-away view of a portion of the umbrella base of FIG. 13 shown in an extended position.

Referring next to FIG. 13, the portable base 70 is preferably extendable, having a telescoping member 86 at one end. A spring 88 is preferably disposed between the telescoping member 86 and an inner wall 90 in order to bias the telescoping member 88 outwardly. A stop clip 92 preferably extends through a slit 94 (see FIG. 11) to prevent the extending member 86 from moving outwardly when not desired. A spring 96 fits into a cavity 98 formed in the extending member 86 to bias the stop clip 92 through the slit 94. Preferably, the telescoping member 86 remains in the closed position shown in FIG. 13 when the bottom anchors **80*a* are used to secure the umbrella 36 on an object, as shown in FIG. 9. The extending member 86 is also preferably kept closed for transportation. When the stop clip 92 is pushed through the slit 94, preferably by a user's finger or thumb, the telescoping member 86 is released and urged by the spring 88 into the extended position shown in FIG. 14. This arrangement is preferably used in conjunction with the end anchors 80*b* when the umbrella base 70 is wedged between two opposing chair frame members 74, as shown in FIG. 10**.

While the described mechanisms have numerous advantages, including stability, wear resistance and reliability, those skilled in the art will appreciate that different mechanisms in addition to those already discussed may be used for slidably and rotatably connecting an umbrella rod to an umbrella base or track. For these additional embodiments, the umbrella base may be formed with channels as discussed above or may be substantially tubular depending on the situation. A number of alternative embodiments are disclosed below.

Figure 15:
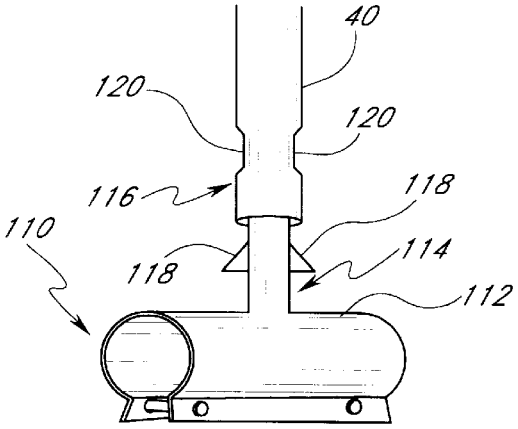
FIG. 15 is a perspective view of another embodiment of an umbrella connector and umbrella rod having features in accordance with the present invention.

FIG. 15 shows a lower cost alternative embodiment wherein a shuttle 110 is adapted to fit around a substantially cylindrical base (not shown). The shuttle 110 has a shuttle base 112 with a substantially C-shaped cross-section. The shuttle base 112 is adapted to snap or clamp about a substantially cylindrical umbrella base. The umbrella base is preferably the top chair frame member 34 or a portable base similar to the portable base 70 discussed above, but without a track. The shuttle 110 includes a rod attachment portion 114 which is adapted to telescopically receive a hollow free end 116 of an umbrella rod 40. Spring loaded locking tabs 118 are adapted to be depressed when the umbrella rod 40 is advanced over the tabs 118, but will spring outwardly through grooves or slits 120 formed on opposing sides of the umbrella rod 40. Thus, the umbrella rod 40 is releasably secured to the shuttle 110. The shuttle 110 is rotatably and longitudinally slidable along the cylindrical umbrella base. Preferably, the shuttle 110 is secured by a wing nut, quick-release bolt, or any other type of fastener. As will be appreciated, this embodiment does not provide the ease of use, reliability or freedom from wear of the other designs, yet provides certain advantages over the prior art.

Figure 17:
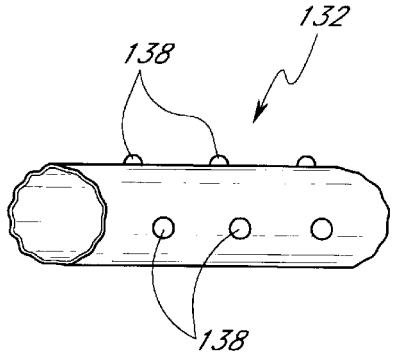
FIG. 17 is a cut out view of an umbrella shuttle base for use with the umbrella connector of FIG. 16.
Figure 16:
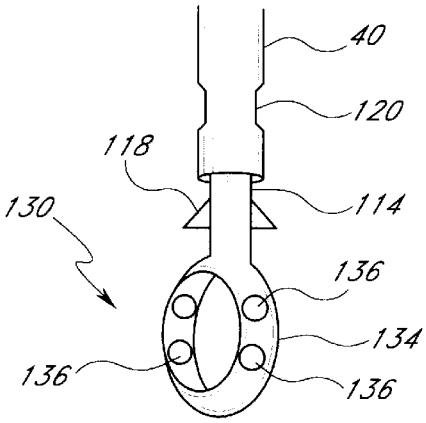
FIG. 16 is a perspective view of yet another embodiment of an umbrella connector having features in accordance with the present invention.

Referring next to FIGS. 16 and 17, another embodiment of an umbrella connector 130 for use with an umbrella base 132 is disclosed. In this embodiment, the umbrella rod 40 is preferably advanced and locked over an umbrella rod attachment portion 114 as discussed above. The connector 130 includes a substantially ring-shaped portion 134 which is adapted to fit about a substantially cylindrical umbrella base 132. As above, the base 132 can comprise the top frame member 34 of a beach chair 30 or a telescopic portable base as discussed above. Preferably, a plurality of holes 136 are formed through the ring-shaped portion 134, which is slidable and rotatable relative to the base 132. Preferably, the base 132 has a number of spring loaded buttons 138 extending therefrom. The buttons 138 are adapted to extend through the holes 136 formed on the connector 130, holding the connector 130 and accompanying umbrella in place. To adjust the umbrella's location, the buttons 138 extending through the holes 136 are depressed, freeing the connector 130 to slide to a new location on the base 132. In an alternative embodiment, the connector may be substantially C-shaped and rigid. The base 132 may be adapted to fit onto various surfaces in addition to a chair frame. For example, the base may be adapted to clip onto a table or cooler or to be staked into the ground. In the embodiment shown in FIG. 17, the base 132 is adapted to snap onto a typical tubular chair frame 32.

Figure 18:
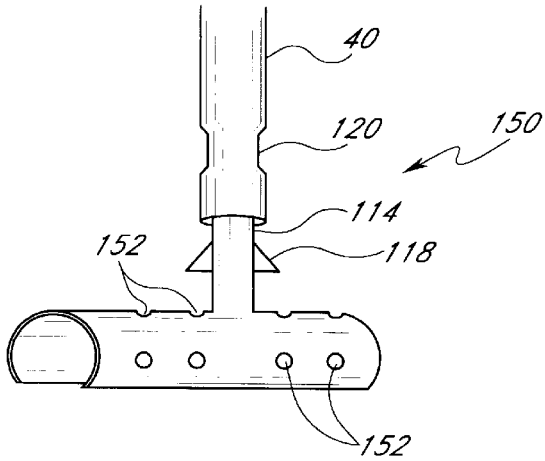
FIG. 18 shows a perspective view of a still further embodiment of an umbrella connector having features in accordance with the present invention.
Figure 19:
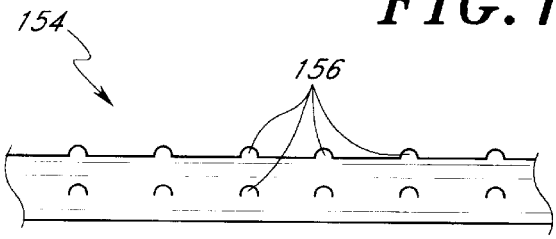
FIG. 19 shows an embodiment of an umbrella base adapted for use with the umbrella connector of FIG. 18.

Referring next to FIG. 18, a connector 150 is disclosed having a substantially C-shaped cross-section and a plurality of holes 152 extending therethrough. A rod attachment portion 114, preferably similar to that described above, is adapted to telescopically accept and lock in place an adjacent umbrella rod 40. Referring also to FIG. 19, the connector 150 is adapted to engage a base 154 which preferably has a plurality of protrusions 156 spaced in a manner to fit through the holes 152 on the corresponding connector 150. In operation, the connector 150 snaps onto and around the umbrella base 154 and the protrusions 156 and holes 152 interact to secure the connector 150 in a location upon the base 154. To rearrange the umbrella, the connector 150 is snapped off of the base 154 and snapped back on in a more desired position. In an alternative embodiment, the protrusions 156 are disposed on the connector 150 and the corresponding holes are formed in the umbrella base 154. In yet a further embodiment, protrusions on the base comprise spring-loaded buttons. Thus, once the connector 150 is snapped onto the base 154, it can be slid into a desired position and be releasably secured in place by actuating the buttons.

Although this invention has been disclosed for use with a beach umbrella to shade a user from sun, those of skill in the art will appreciate that the principles of the present invention may be applied for other uses. For instance, other applications include adjustably holding a light, soft drink, or even a book.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. An adjustable umbrella apparatus, comprising:

a track;

a shuttle adapted to slide along the track and having a first interlock portion;

a second interlock portion adapted to engage the first interlock portion to releasably lock the shuttle in a first position;

a third interlock portion adapted to engage the first interlock portion to releasably lock the shuttle in a second position; and an umbrella rod connected to the shuttle and adapted to move with the shuttle.

2. The umbrella apparatus of claim 1 in combination with a chair frame, wherein the track is integral with the chair frame.

3. The umbrella apparatus of claim 1, including at least one anchor coupled to the track to releasably secure the apparatus to an object.

4. The umbrella apparatus of claim 3, wherein the at least one anchor is adapted to engage a chair frame.

5. The umbrella apparatus of claim 1, wherein the track is adapted to be longitudinally extendable.

6. The umbrella apparatus of claim 5, wherein the track is longitudinally spring-loaded.

7. The umbrella apparatus of claim 6, wherein the track is sized and adapted to extend between opposing frame members of a beach chair.

8. The umbrella apparatus of claim 1, wherein the track includes a channel, and the shuttle is longitudinally slidable within the channel.

9. The umbrella apparatus of claim 8, wherein the shuttle is rotatable relative to a longitudinal axis of the track.

10. The umbrella apparatus of claim 8, wherein said first interlock portion includes at least one prong and said second and third interlock portions each include at least one cavity adapted to receive said prong.

11. The umbrella apparatus of claim 10, wherein the first interlock portion is spring-loaded toward a locked position, and the shuttle is slidable when the first interlock portion is in an unlocked position.

12. An adjustable umbrella system, comprising:

an umbrella including a canopy and a shaft supporting said canopy;

a base;

a connector on a first end of the shaft, the connector adapted to engage the base and to move longitudinally along the base and rotatably about a longitudinal axis of the base; and an interlock on the base adapted to engage the connector and releasably lock the connector in a position.

13. The umbrella system of claim 12, including at least one anchor coupled to the base to releasably secure the system to an object.

14. The umbrella system of claim 13, wherein the at least one anchor is adapted to engage a chair frame.

15. The umbrella system of claim 12, wherein the connector includes a plurality of cavities, and the first and second interlocks each include a protrusion adapted to releasably engage at least one of the connector cavities.

16. An adjustable umbrella system, comprising:

an umbrella including a rod supporting a canopy at a first end;

a base;

a connector on a second end of the rod, the connector adapted to releasably engage the base; and a plurality of protrusions on one of the base and connector, the protrusions adapted to engage the other of the base and connector to retain the connector in a position on the base.

17. The umbrella system of claim 16, wherein the protrusions comprise spring-loaded buttons and the connector has at least one hole adapted to releasably engage one of said buttons.

18. The umbrella system of claim 16, wherein the connector is adapted to be snap-fittable onto the base.

19. The umbrella system of claim 16 in combination with a chair frame, wherein the base is formed integrally with the chair frame.

20. An adjustable umbrella apparatus, comprising:

an umbrella comprising a canopy and a rod;

a base;

a channel formed in said base, the channel having a longitudinal portion and a transverse portion;

a plurality of lock holes adjacent the channel; and a connector attached to the umbrella rod and adapted to slide within the base, said connector including an interlock adapted to engage at least one of the lock holes.

* * * * *